US005997422A

United States Patent [19]

Cooper

[11] Patent Number: 5,997,422

[45] Date of Patent: Dec. 7, 1999

[54] WATERPROOF GAME BALL

[75] Inventor: John Scott Cooper, Waikele, Hi.

[73] Assignee: CoopSport International Ltd., Hi.

[21] Appl. No.: 08/914,255

[22] Filed: Aug. 18, 1997

[51] Int. Cl.[6] ..... A63B 41/00

[52] U.S. Cl. ..... 473/599; 473/603

[58] Field of Search ..... 473/594, 598, 473/599, 603, 604, 605, 609

[56] References Cited

U.S. PATENT DOCUMENTS

| | | | |
|---|---|---|---|
| 1,385,095 | 7/1921 | Roberts . | |
| 3,119,618 | 1/1964 | Molitor et al. | 473/599 |
| 3,185,476 | 5/1965 | Fechner . | |
| 4,000,894 | 1/1977 | Butzen . | |
| 4,238,537 | 12/1980 | Kerr . | |
| 4,660,831 | 4/1987 | Keralik . | |
| 4,834,382 | 5/1989 | Spector | 473/603 |
| 4,887,814 | 12/1989 | Winter . | |
| 4,917,381 | 4/1990 | Spector | 473/594 |
| 4,974,844 | 12/1990 | Richards . | |
| 5,069,935 | 12/1991 | Walters | 473/599 |
| 5,228,687 | 7/1993 | Luecke et al. . | |
| 5,251,908 | 10/1993 | Myers . | |
| 5,333,648 | 8/1994 | Aoyama | 473/604 |
| 5,413,331 | 5/1995 | Stillinger . | |
| 5,542,662 | 8/1996 | Kouzai et al. | 473/605 |
| 5,636,835 | 6/1997 | Schindler et al. | 473/605 |
| 5,669,838 | 9/1997 | Kennedy et al. | 473/599 |
| 5,759,123 | 6/1998 | Qu | 473/599 |

*Primary Examiner*—Steven Wong
*Attorney, Agent, or Firm*—Adams & Wilks

[57] ABSTRACT

A waterproof game ball comprises elastically stretchable panels connected and sealed together along marginal edge portions thereof to define a shell, and a flexible, inflatable bag disposed within the shell for receiving air to inflate the bag. Each of the elastically stretchable panels has a main body formed from a single piece of flexible, non-porous, water-impervious material.

34 Claims, 3 Drawing Sheets

WATERPROOF GAME BALL

BACKGROUND OF THE INVENTION

1. Field of the Invention

The present invention relates to a waterproof game ball and, more particularly, to a flexible waterproof game ball constructed of water-impervious material for use in wet environments and for enhancing safety during training or informal play.

2. Background of the Invention

Conventional regulation game balls (e.g., football, baseball, basketball) are inappropriate for use in wet environments, such as in a pool, at the beach or in the rain. Upon contact with water, conventional regulation game balls tend to become stiff and heavy, which adversely affects the flexibility and usability of the ball. Additionally, conventional regulation game balls are unable to effectively protect the interior thereof against moisture.

Moreover, during training of players at all levels in the sports of football, baseball and basketball, for example, fundamentals are oftentimes not properly learned due to the fear associated with the hard regulation game ball. Actual injuries and the fear thereof have a profound impact on the ability of younger players to relax and learn the game. In numerous instances, the potential risk of being hit by thrown regulation balls leads many beginners to shun the sport.

Apart from the training potential afforded by a game ball that is softer than regulation game balls, some circumstances call for a recreational game ball that is safer than a regulation football, baseball or basketball. At the commonplace family or office picnic, for example, pickup football, baseball or basketball games occur in which the skill levels vary widely among the participants. Such games are usually played near crowds and in confined areas. Usually no protective equipment is available for the players. Play with a regulation football, baseball and basketball in such situations is imprudent because of the risk of injury, and it is not infrequent that players will be injured during play due to being hit by the game ball.

Poor weather often forces the play of ball sports indoors, for example, into a gymnasium. The risk of property damage in confined indoor areas from regulation footballs and baseballs, for example, has largely relegated the use of gyms to ball sports such as basketball, volleyball, badminton and similar sports. Window breakage, abrasion and scuffing of floors and destruction of wallboard, light fixtures, and other property is almost certain to occur if a regulation football or baseball is used indoors. Insurance premiums for gymnasiums in which football and baseball practices are regularly held are higher as a result of the risk of physical property damage. Additionally, the risk of player injury increases dramatically as a result of the closer proximity of the players to each other and the hardness of the surfaces from which a ball in play can rebound.

Prior attempts have been made to provide a safe, high performance, durable recreational game ball. One extremely soft, cellular plastic foam recreational game ball has been provided for simulated play and the training of the young. Such conventional recreational game balls, however, being formed of open cell foams, are extremely light in weight and have unrealistic dynamic characteristics. In addition, they are rather flimsy, absorbent of moisture, and are not intended to be used by advanced football or baseball players for serious practice or training.

Other attempts to provide safe, high performance, durable recreational game balls has resulted in game balls which are readily distortable, easily affected by water and rather easily destructible. Moreover, while other conventional game balls tend to replicate regulation game balls in weight and performance, they offer no increased safety to players. On the other hand, conventional game balls which are characterized as being soft and safe do not accurately replicate either the appearance, texture, or surface features of regulation game balls.

The present invention overcomes many of the disadvantages inherent in conventional game balls used in wet environments and/or during training or informal play.

SUMMARY OF THE INVENTION

It is an object of the present invention to provide a waterproof game ball which resists the absorption of water and may be used in wet environments without damaging the ball or adversely affecting the flexibility and usability of the ball and which will retain its shape during prolonged and repeated use.

Another object of the present invention to provide a durable waterproof game ball for play and training in game sports, which is constructed so as to substantially reduce the risk of injury to players and physical damage to property, and which has performance and surface characteristics closely simulating those of a regulation game ball.

Another object of the present invention is to provide a durable waterproof game ball which may be used as a training ball to build confidence and playing skills and which can be used to play recreational games by players of varying skills without protective equipment.

Still a further object of the present invention is to provide a recreational waterproof game ball which may be used as a competitive game ball in informal settings and which is relatively easy and economical to manufacture.

The foregoing and other objects of the present invention are carried out by a waterproof game ball comprising a plurality of flexible panels connected and sealed together along marginal edge portions thereof to define a shell, and a elastically stretchable inflatable bag disposed within the shell for receiving air to inflate the bag. Each of the elastically stretchable panels has a main body formed from a single piece of flexible, non-porous, water-impervious material, and the marginal edge portions of the elastically stretchable panels are preferably connected and sealed together with an adhesive and sewn along stitch lines.

BRIEF DESCRIPTION OF THE DRAWINGS

The foregoing summary, as well as the following detailed description of a preferred embodiment of the invention, will be better understood when read in conjunction with the accompanying drawings. For the purpose of illustrating the invention, there is shown in the drawings an embodiment which is presently preferred. It should be understood, however, that the invention is not limited to the precise arrangement and instrumentalities shown. In the drawings.

DETAILED DESCRIPTION OF THE PREFERRED EMBODIMENT

Figure 1:
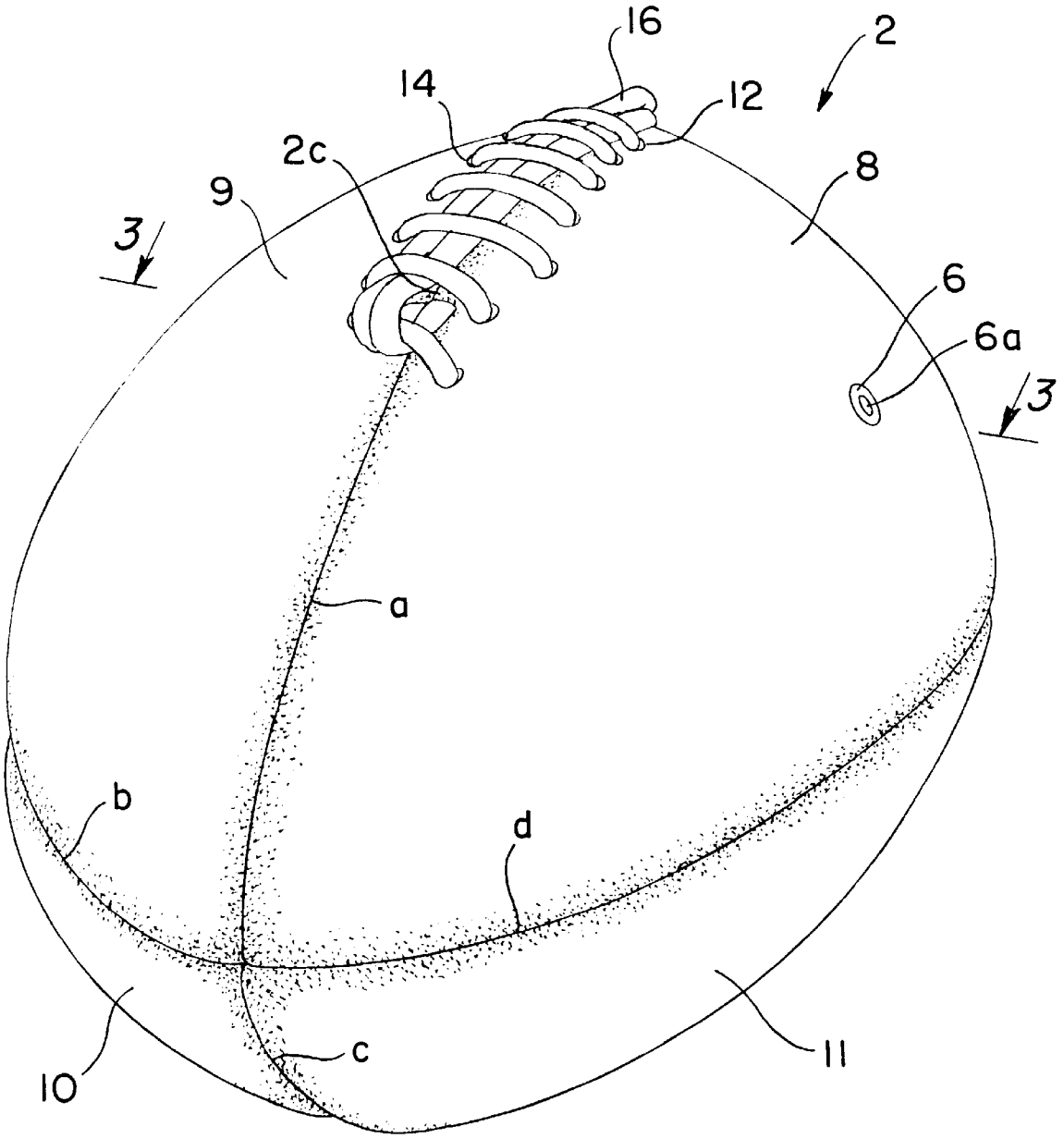
FIG. 1 is a perspective view of a waterproof game ball according to the present invention.

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

The preferred embodiment of the waterproof game ball according to the present invention is described below with a specific application to a football. However, it will be appreciated by those of ordinary skill in the art that the present invention is also well adapted for other game balls, such as, for example, baseballs, softballs, basketballs and volleyballs.

Referring now to the drawings in detail, wherein like numerals are used to indicate like elements throughout, there is shown in FIGS. 1–4 an embodiment of a waterproof game ball, generally designated at 2, according to the present invention. The waterproof game ball 2 has a body of generally oval configuration having an outer surface, a lengthwise axis A, two opposite ends 2*a,* 2*b,* and a maximum diameter midway between the ends, thereby replicating the appearance of a regulation football. The football has a bladder 4 in the form of a flexible, inflatable bag, and an inflation valve 6 projecting outwardly therefrom. The bladder 4 has a generally oval configuration and is adapted to be filled with air through the inflation valve 6. The preferred material for the bladder 4 is butyl rubber or latex. Other suitable materials include, but are not limited to, natural rubber, mixes of butyl rubber and natural rubber polyurethane.

Figure 3:
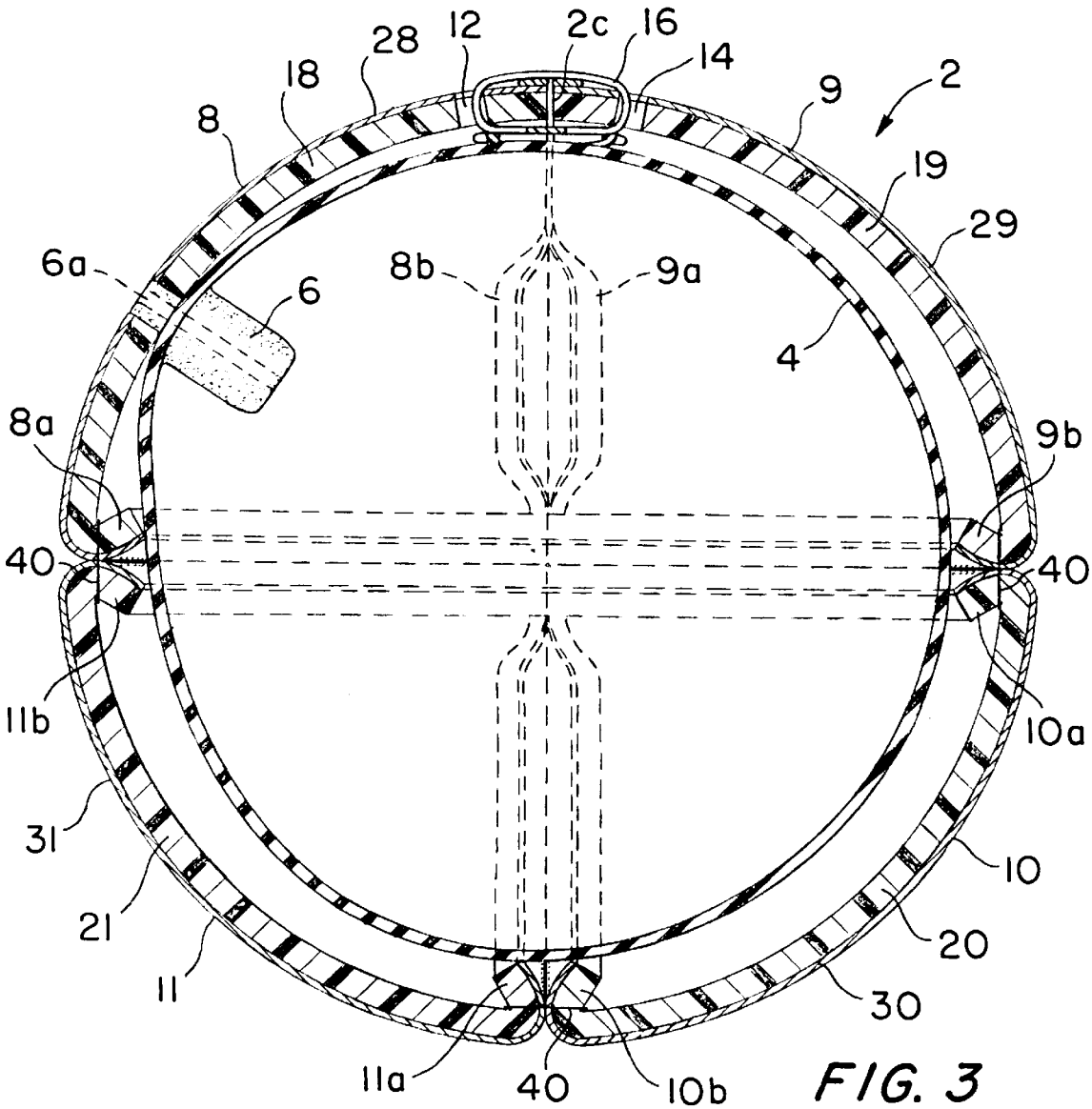
FIG. 3 is a sectional view taken in the direction of line 3—3 of FIG. 1.

An elastically stretchable outer casing or shell surrounds the bladder 4 and is formed of four separate substantially identical elastically stretchable flexible panels 8–11 sealed together along marginal edge portions 8*a*,8*b,* 9*a*,9*b,* 10*a*,10*b* and 11*a,*11*b* to define four equally spaced seams a, b, c and d extending the length of the football 2. More specifically, as shown in FIG. 3, panels 8 and 9 are sealed together at marginal edge portions 8*b*,9*a* to form seam a, panels 9 and 10 are sealed together at marginal edge portions 9*b,*10*a* to form seam b, panels 10 and 11 are sealed together at marginal edge portions 10*b,*11*a* to form seam c, and panels 8 and 11 are sealed together at marginal edge portions 8*a,*11*b* to form seam d. In this embodiment, each of the panels 8–11 has the configuration of a quadrant of an oval, and when the quadrant panels are sealed together along marginal edge portions 8*a*,8*b,* 9*a*,9*b,* 10*a*,10*b* and 11*a*,11*b* thereof, they jointly create the shell for receiving the bladder 4. As shown in FIG. 3, the marginal edge portions protrude from seams a, b, c and d, extend inwardly into the shell of the football 2, and are in contact with the inflated bladder 4. By this construction, the outer surface of the body of the football 2 achieves a generally smooth oval configuration which substantially replicates the appearance, texture and surface features of a regulation football. The inflation valve 6 of the bladder 4 is integrally connected to the panel 8 of the shell so that a normally-closed air passage 6*a* of the inflation valve communicates with the outer surface of the football to enable filling of the bladder with air by means of a handheld pump.

Figure 2:
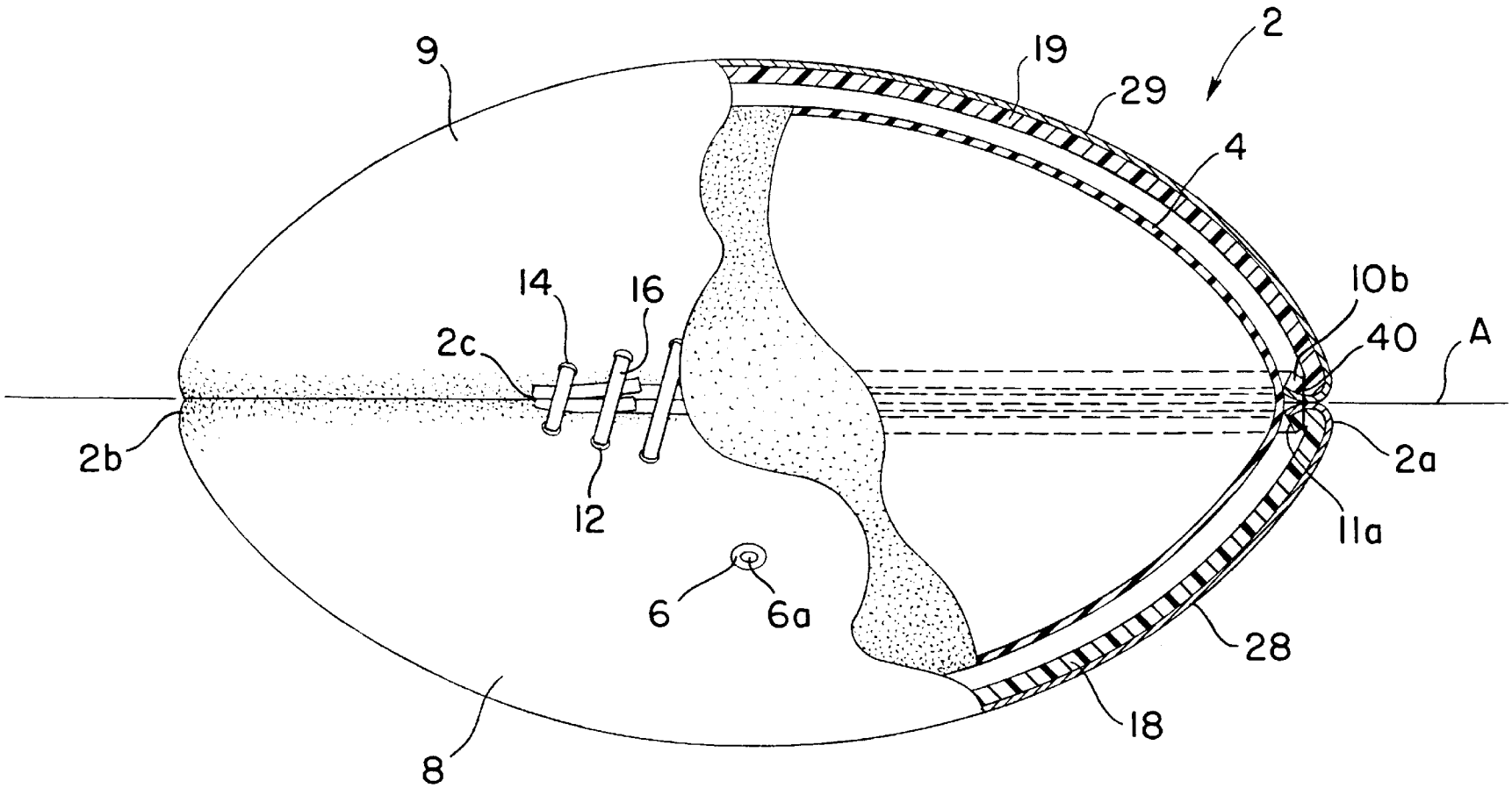
FIG. 2 is top view of the waterproof game ball according to the present invention with portions removed to illustrate the internal construction of the waterproof game ball.

Referring to FIGS. 1 and 2, the panels 8 and 9 are sealed together to define a gap 2*c* extending lengthwise along a central portion of the football 2 to enable insertion of the bladder 4 during assembly of the football. The panels 8 and 9 are provided with holes 12 and 14, respectively, extending along the gap 2*c*. Lacing 16 extends through the holes 12 and 14, crossing the gap 2*c,* and ties the panels 8 and 9 together in a waterproof manner to prevent exposure of the bladder 4 to the outside of the football and to substantially totally prevent liquid from entering the interior of the football. When a player throws the football 2, the player grasps the football with his fingertips on the lacing 16. Thus the lacing 16 further enhances traction which improves the throw of the football 2 while maintaining perfect balance of the football. The preferred material for the lace 16 is, for example, a suitable plastic.

Figure 4:
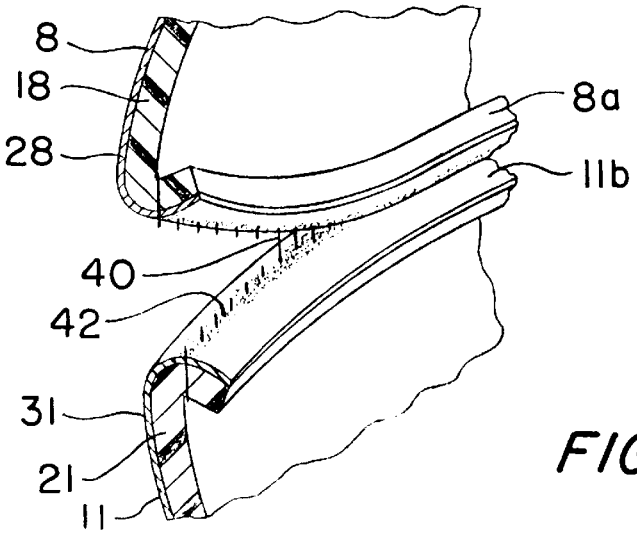
FIG. 4 is an enlarged fragmentary view of a portion of the waterproof game ball in FIG. 1 showing two of the flexible panels prior to sealing.

According to this embodiment, the elastically stretchable panels 8–11 are of multi-layer construction and are formed of layers 18–21 of substantially water-impervious material, and layers 28–31 composed of a fabric material disposed on one or both opposed major surfaces of respective ones of the water-impervious layers 18–21 and defining the outer surface of the football 2. Each of the layers 18–21 constitutes a main body of the respective panels 8–11. The marginal edge portions of the panels 8–11 are sealed by a sewing process along stitch lines 40. Although stitching alone of the marginal edge portions of the panels 8–11 is usually sufficient to keep water out of the interior of the waterproof game ball 2, additional means may be provided for further sealing the panels in a waterproof manner. Accordingly, as shown in FIG. 4, the marginal edge portions of the panels 8–11 are heat sealed using a suitable adhesive 42, for example, thermoplastics synthetic resin adhesives or thermal setting synthetic resin adhesives. However, it is understood by those skilled in the art that other suitable means may be used for further waterproof sealing the stitched marginal edge portions of the panels. For example, after the stitching process, the marginal edge portions may be sealed with a seam sealer, waterproof tape or the like.

Preferably, a single piece of nonporous synthetic rubber material which is impervious to water, such as closed-cell neoprene, is used as the water-impervious material for the main body of each of the layers 18–21. Closed-cell neoprene is a non-porous rubber material which not only exhibits excellent waterproof properties, but also has a desirable flexible property which permits it to be repeatedly elastically deformed without damage or permanent deformation while providing structural integrity to the football 2. However, it is understood by those skilled in the art that other synthetic rubber materials exhibiting the above properties may be used for the layers 18–21.

The fabric layers 28–31 are preferably made of thin layers of nylon which are preferably bonded to the water-impervious layers 18–21, respectively. During use of the football in wet environments, the thin nylon layers, which define the outer surface of the football 2, protect the water-impervious layers 18–21 and retain some moisture to give the football some weight to provide the football with realistic dynamic characteristics, such as stability and better ball handling. Thus the properties of nylon allow the football to be used in wet environments without damaging the football or adversely affecting the flexibility and useability of the football. Other suitable materials for the fabric layers 28–31 which exhibit the above properties include, but are not limited to, lycra, polyester and fleece.

The assembly of the football 2 according to the present embodiment will be explained below with reference to FIGS. 1–4.

The panels 8–11 are first cut to an appropriate size from a suitable material comprised of a fabric layer bonded to a water-impervious layer composed of a closed-cell rubber material, such as closed-cell neoprene, the cutting being done either manually or with an industrial cutting machine, using a generally oval-shaped pattern. The fabric layers 28–31 are thus bonded to respective ones of the water-impervious layers 18–21 prior to the foregoing cutting step by, for example, a conventional heat bonding process. In this embodiment, a fabric layer is bonded to an outer surface of each of the water-impervious layers which corresponds to the outer surface of the assembled football 2. In an alternative embodiment, a fabric layer may also be bonded to an inner surface of each of the water-impervious layers which corresponds to the interior of the shell.

The marginal edge portions of respective adjoining panels are superposed and sewn together, as shown by the stitch lines 40 in FIGS. 2–4, using, for example, an industrial sewing machine, to form the seams a, b, c, and d and create a shell for receiving the bladder 4. More specifically, as shown in FIG. 3, panels 8 and 9 are sewn together at marginal edge portions 8*b*,9*a* to form seam a, panels 9 and 10 are sewn together at marginal edge portions 9*b*,10*a* to form seam b, panels 10 and 11 are sewn together at marginal edge portions 10*b*,11*a* to form seam c, and panels 8 and 11 are sewn together at marginal edge portions 8*a*,11*b* to form seam d. After the foregoing steps, the marginal edge portions protrude inwardly from the seams a, b, c and d and extend into the shell of the football 2 in contact with the inflated bladder 4. By this construction, the outer surface of the body of the football 2 has a generally smooth oval configuration which substantially replicates the appearance, texture and surface features of a regulation football.

As shown in FIGS. 1 and 2, the marginal edge portions 8*b* and 9*a* of the panels 8 and 9, respectively, are not completely sewn together along the length of the football 2. Instead, sections of the marginal edge portions 8*b* and 9*a* along a central portion of the football 2 are not sewn together to thereby form the lengthwise extending gap 2*c* to enable insertion of the bladder 4. Before sewing together the marginal edge portions of the panels 8–11, a suitable adhesive 42, as shown in FIG. 4, is preferably applied to the marginal edge portions of the panels (excluding the sections of the marginal edge portions of panels 8 and 9 defining the gap 2*c*).

Instead of, or in addition to, applying the adhesive 42 to the marginal edge portions of the panels 8–11, a suitable seam sealer, waterproof tape or other sealing means may be applied over the stitching 40 to obtain the waterproofness of the football.

The stitching is sewn while the panels 8–11 are inside out. The shell is subsequently turned right-side out so that the fabric layers 28–31 define the outer surface of the football, and then the bladder 4 is inserted. The lacing 16 is then passed through the holes 12 and 14 provided in the panels 8 and 9, respectively, crossing the gap 2*c*, and the panels 8 and 9 are tied together to prevent exposure of the bladder 4 to the outside.

The waterproof game ball according to the present invention as generally described and illustrated in the figures herein could be constructed using any number of acceptable methods in a wide variety of different configurations. For example, the number of waterproof panels for the shell of the waterproof game ball may be less than or greater than four and of different dimensions and configurations, and may be assembled to configure game balls other than a football such as, for example, baseballs, softballs, basketballs and volleyballs. Thus, the foregoing detailed description of the presently preferred embodiment of the invention is only illustrative of the nature of the invention and is not intended to limit the scope thereof.

The unique construction and the combination of materials from which the waterproof game ball of the present invention is comprised thus results in a highly versatile waterproof game ball that extends the opportunities for training of players of any degree of experience, age or strength. The waterproof game ball of the present invention may be used by relatively unskilled players without protective equipment, even indoors, with little or no risk of injury to players or risk physical damage to property.

The waterproof game ball of the present invention, with each of its panels comprising a water-impervious layer composed of a non-porous, closed-cell rubber material, such as closed-cell neoprene, and a thin fabric layer, such as nylon, disposed on a surface of the water-impervious layer to define the outer surface of the waterproof game ball, results in a substitute game ball of enhanced safety but having minimal degradation of performance characteristics from the standard. The surface features and texture of the waterproof game ball of the present invention replicate those of the standard game ball for which they may be substituted. Therefore, the grip and aerodynamic characteristics of the waterproof game ball according to the present invention permits users thereof to acquire facility that will eventually permit them to master the sport played with the corresponding standard game ball.

Moreover, the inventive waterproof game ball, which may be manufactured in any size and weight, is highly durable and resistant to structural or performance degradation. Thus the waterproof game ball according to the present invention is particularly well adapted for use in wet environments without damaging the ball or adversely affecting the flexibility and usability of the ball.

From the foregoing description, it can be seen that the present invention comprises an improved waterproof game ball. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

I claim:

1. A waterproof game ball comprising: a plurality of elastically stretchable panels connected and sealed together along marginal edge portions thereof to define a shell, each of the elastically stretchable panels having a main body formed from a single piece of flexible, non-porous, water-impervious material; and a flexible, inflatable bag disposed within the shell for receiving air to inflate the bag.

2. A waterproof game ball according to claim 1; wherein the single piece of flexible, non-porous, water-impervious material comprises synthetic rubber.

3. A waterproof game ball according to claim 2; wherein the synthetic rubber comprises closed-cell neoprene.

4. A waterproof game ball according to claim 3; wherein the marginal edge portions of the flexible panels are connected and sealed together with an adhesive and sewn along stitch lines.

5. A waterproof game ball according to claim 1; wherein the marginal edge portions of the flexible panels are connected and sealed together with an adhesive and sewn along stitch lines.

6. A waterproof game ball according to claim 1; wherein the shell comprises a body of generally oval configuration having an outer surface, two opposite ends, and a maximum diameter midway between the ends.

7. A waterproof game ball according to claim 6; wherein the single piece of flexible, non-porous, water-impervious material comprises synthetic rubber.

8. A waterproof game ball according to claim 7; wherein the synthetic rubber comprises closed-cell neoprene.

9. A waterproof game ball according to claim 1; wherein each of the elastically stretchable panels has a thin fabric layer disposed on a surface of the main body.

10. A waterproof game ball comprising: a plurality of separate elastically stretchable panels connected and sealed together along marginal edge portions thereof by stitching extending along stitch lines to define a shell, each of the elastically stretchable panels having a main body formed from a single piece of flexible, non-porous, water-impervious material, and an inflatable bladder disposed within the shell and being inflatable with air to expand the shell.

11. A waterproof game ball according to claim 10; wherein the single piece of flexible, non-porous, water-impervious material comprises synthetic rubber.

12. A waterproof game ball according to claim 11; wherein the synthetic rubber comprises closed-cell neoprene.

13. A waterproof game ball according to claim 10; wherein the shell has an outer surface, a lengthwise axis and two opposite ends; and wherein the stitch lines define a plurality of seams on the outer surface of the shell and extending the length of the shell.

14. A waterproof game ball according to claim 13; wherein one of the seams is interrupted by a gap extending lengthwise along a central portion of the shell; and further comprising sealing means for sealing the gap in a waterproof manner to substantially totally prevent liquid from entering the interior of the shell.

15. A waterproof game ball according to claim 14; wherein the shell has a generally oval configuration and a maximum diameter midway between the ends.

16. A waterproof game ball according to claim 15; wherein each of the elastically stretchable panels has a thin fabric layer disposed on a surface of the main body.

17. A waterproof game ball according to claim 16; wherein the single piece of flexible, non-porous, water-impervious material comprises closed-cell neoprene.

18. A waterproof game ball according to claim 9; wherein the thin fabric layers define an outer surface of the shell.

19. A waterproof game ball according to claim 18; wherein the thin fabric layers are bonded respectively on the cores.

20. A waterproof game ball according to claim 18; wherein the thin fabric layers are comprised of nylon.

21. A waterproof game ball according to claim 16; wherein the thin fabric layers define an outer surface of the shell.

22. A waterproof game ball according to claim 21; rein the thin fabric layers are bonded respectively on the main bodies.

23. A waterproof game ball according to claim 21; wherein the thin fabric layers are comprised of nylon.

24. A waterproof game ball comprising: an elastically stretchable outer casing formed of a plurality of flexible panels connected and sealed together along marginal edge portions thereof, each of the flexible panels consisting essentially of a main body formed from a single piece of non-porous, water-impervious material and a fabric layer bonded on one or both opposed major surfaces of the main body; and a flexible, inflatable bag disposed within the shell for receiving air to inflate the bag.

25. A waterproof game ball according to claim 24; wherein the fabric layers of the flexible panels define an outer surface of the elastically stretchable outer casing.

26. A waterproof game ball according to claim 25; wherein the thin fabric layers are comprised of nylon.

27. A waterproof game ball according to claim 24; wherein the single piece of flexible, non-porous, water-impervious material comprises synthetic rubber.

28. A waterproof game ball according to claim 27; wherein the synthetic rubber comprises closed-cell neoprene.

29. A waterproof game ball according to claim 28; wherein the marginal edge portions of the flexible panels are connected and sealed together with an adhesive and sewn along stitch lines.

30. A waterproof game ball according to claim 24; wherein the marginal edge portions of the flexible panels are connected and sealed together with an adhesive and sewn along stitch lines.

31. A waterproof game ball according to claim 24; wherein the elastically stretchable outer casing comprises a body of generally oval configuration having an outer surface, two opposite ends, and a maximum diameter midway between the ends.

32. A waterproof game ball according to claim 24; wherein the fabric layers of the flexible panels are comprised of nylon.

33. A waterproof game ball according to claim 1; further comprising a thin fabric layer bonded on opposed major surfaces of the main body of each of the elastically stretchable panels.

34. A waterproof game ball according to claim 10; further comprising a thin fabric layer bonded on opposed major surfaces of each main body of each of the elastically stretchable panels.

* * * * *

UNITED STATES PATENT AND TRADEMARK OFFICE

CERTIFICATE OF CORRECTION

PATENT NO. : 5,997,422
DATED : December 7, 1999
INVENTOR(S) : John Scott Cooper

It is certified that error appears in the above-identified patent and that said Letters Patent is hereby corrected as shown below:

Column 2,
Line 38, "flexible" should read -- elastically stretchable --.
Line 40, "eleastically stretchable" should read -- flexible --.
Line 66, "flexible" should read -- elastically stretchable --.

Claim 19, Column 7,
Line 50, change "cores" to -- main bodies --.

Claim 22, Column 8,
Line 4, change "rein" to -- wherein --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*